US008693929B2

(12) United States Patent
Yoshida et al.

(10) Patent No.: US 8,693,929 B2
(45) Date of Patent: Apr. 8, 2014

(54) IMAGE FORMING APPARATUS

(75) Inventors: Tomohisa Yoshida, Toyokawa (JP); Masayasu Haga, Toyokawa (JP); Kanji Nakayama, Toyokawa (JP); Wataru Onoda, Toyokawa (JP); Narutaka Yoshida, Toyokawa (JP); Noboru Ito, Kawanishi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 86 days.

(21) Appl. No.: 13/343,157

(22) Filed: Jan. 4, 2012

(65) Prior Publication Data

US 2012/0177415 A1 Jul. 12, 2012

(30) Foreign Application Priority Data

Jan. 6, 2011 (JP) ..... 2011-001066

(51) Int. Cl.
*G03G 15/08* (2006.01)

(52) U.S. Cl.
USPC ..... 399/285; 399/267

(58) Field of Classification Search
USPC ..... 399/267, 285
See application file for complete search history.

(56) References Cited

U.S. PATENT DOCUMENTS

| | | | | |
|---|---|---|---|---|
| 4,653,427 | A * | 3/1987 | Hosaka et al. | 399/270 |
| 5,440,378 | A | 8/1995 | Matsuura | |

FOREIGN PATENT DOCUMENTS

| | | | | |
|---|---|---|---|---|
| JP | 55-84652 | | 6/1980 | |
| JP | 04-190375 | | 7/1992 | |
| JP | 05-067537 | | 3/1993 | |
| JP | 6-118798 | A | 4/1994 | |
| JP | 08-006401 | | 1/1996 | |
| JP | 8-194376 | A | 7/1996 | |
| JP | 09-050186 | | 2/1997 | |
| JP | 09-329938 | | 12/1997 | |
| JP | 2002-268381 | A | 9/2002 | |
| JP | 2005010556 | A * | 1/2005 | G03G 15/08 |
| JP | 2006-091247 | | 6/2006 | |
| JP | 2006-243120 | | 9/2006 | |
| JP | 2007-057896 | | 3/2007 | |
| JP | 2009-98593 | A | 5/2009 | |
| JP | 2009-157266 | A | 7/2009 | |

(Continued)

OTHER PUBLICATIONS

Japanese Office Action (Decision to Grant a Patent) issued in Japanese Patent Application No. 2011-001066, dated Jul. 2, 2013, and English translation thereof (6 pages).

(Continued)

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

An image forming apparatus for forming a toner image on a print medium with a developer composed of toner and carriers, wherein when the first distance is longer than the second distance, an average gap between the first peripheral surface and a member that faces to the first peripheral surface in an area with a length of the first distance extending upstream from the closest point with respect to the specified direction is smaller than an average gap between the first peripheral surface and a member that faces to the first peripheral surface in an area with a length of the first distance extending downstream from the closest point with respect to the specified direction.

5 Claims, 5 Drawing Sheets

(56) References Cited

FOREIGN PATENT DOCUMENTS

| | | | | | |
|---|---|---|---|---|---|
| JP | 2009157266 | A | * | 7/2009 | ..... G03G 15/08 |
| JP | 2009-192775 | | | 8/2009 | |
| JP | 2009-192775 | A | | 8/2009 | |

OTHER PUBLICATIONS

Notification of Reasons for Refusal issued in corresponding Japanese Patent Application No. 2011-001066, dated Apr. 23, 2013, and English translation thereof.

* cited by examiner

IMAGE FORMING APPARATUS

This application is based on Japanese Patent Application No. 2011-001066 filed on Jan. 6, 2011, the content of which is herein incorporated by reference.

BACKGROUND OF THE INVENTION

1. Field of the Invention

The present invention relates to an image forming apparatus, and more particularly to an image forming apparatus for forming a toner image on a print medium with a developer composed of toner and carriers.

2. Description of Related Art

As a conventional image forming apparatus, for example, an image forming apparatus disclosed by Japanese Patent Laid-Open Publication No. 2009-98593 is known. The image forming apparatus adopts a DC development method, wherein development is performed by applying a DC voltage between a developer support member and an image support member. In the image forming apparatus disclosed by Japanese Patent Laid-Open Publication No. 2009-98593, since the DC development is adopted, it is not necessary to apply an AC voltage between the developer support member and the image support member. Therefore, the structure of the image forming apparatus can be simple.

However, the image forming apparatus adopting the DC development method has a problem that toner images formed thereby are more prone to density unevenness than toner images formed by image forming apparatuses adopting an AC development method.

In the AC development method, generally, a voltage with an amplitude of about 700V is applied between a developer support member and an image support member. In this case, since a relatively high voltage is applied between the developer support member and the image support member, a relatively large amount of toner contributes to development. Therefore, in an image forming apparatus adopting the AC development method, even if the gap between the developer support member and the image support member fluctuates due to non-uniform rotations of the developer support member and the image support member, it is less likely that toner images formed thereby have density unevenness.

In the DC development method, on the other hand, a DC voltage of about 150V is applied between a developer support member and an image support member. In this case, since a relatively low voltage is applied between the developer support member and the image support member, only a relatively small amount of toner contributes to development. Therefore, in an image forming apparatus adopting the DC development method, if the gap between the developer support member and the image support member fluctuates due to non-uniform rotations of the developer support member and the image support member, toner images formed thereby are prone to density unevenness.

SUMMARY OF THE INVENTION

An object of the present invention is to provide an image forming apparatus that prevents toner images formed thereby from having density unevenness.

An image forming apparatus according to an embodiment of the present invention is to form a toner image on a print medium with a developer composed of toner and carriers, and the image forming apparatus comprises: an image support member having a first peripheral surface for supporting an electrostatic latent image thereon, the first peripheral surface traveling in a specified direction; a developing device comprising a developer support member having a second peripheral surface for supporting the developer thereon, the second peripheral surface traveling in a direction opposite to the first peripheral surface at a point where the second peripheral surface faces to the first peripheral surface, the developing device attracting the carriers of the developer by an effect of a magnetic field so as to hold the developer on the second peripheral surface; and a voltage applying device for applying a DC voltage to the second peripheral surface such that the electrostatic latent image supported on the first peripheral surface is developed with the developer supported on the second peripheral surface; wherein between the first peripheral surface and the second peripheral surface, an area in which the developer is in contact with the first peripheral surface is defined as a nip area, a distance between a most upstream point, with respect to the specified direction, of the nip area and a closest point at which the first peripheral surface and the second peripheral surface are the closest to each other is defined as a first distance, and a distance between a most downstream point, with respect to the specified direction, of the nip area and the closest point is defined as a second distance; wherein when the first distance is longer than the second distance, an average gap between the first peripheral surface and a member that faces to the first peripheral surface in an area with a length of the first distance extending upstream from the closest point with respect to the specified direction is smaller than an average gap between the first peripheral surface and a member that faces to the first peripheral surface in an area with a length of the first distance extending downstream from the closest point with respect to the specified direction; and wherein when the first distance is equal to or shorter than the second distance, an average gap between the first peripheral surface and a member that faces to the first peripheral surface in an area with a length of the second distance extending upstream from the closest point with respect to the specified direction is smaller than an average gap between the first peripheral surface and a member that faces to the first peripheral surface in an area with a length of the second distance extending downstream from the closest point with respect to the specified direction.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Some image forming apparatuses according to preferred embodiments of the present invention will be hereinafter described.

First Embodiment

Structure of the Image Forming Apparatus

Figure 1:
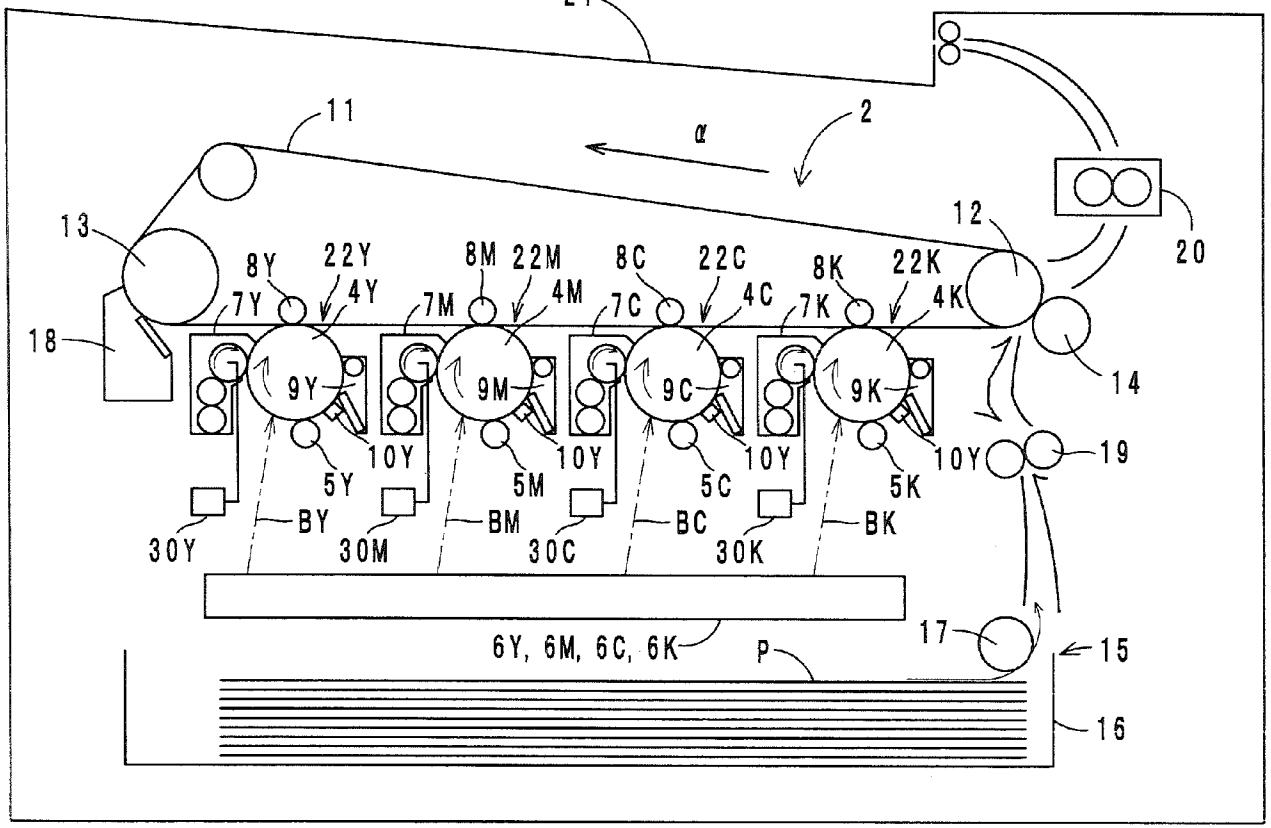
FIG. 1 is a skeleton framework of an image forming apparatus.

An image forming apparatus according to a first embodiment of the present invention is described with reference to the drawings. FIG. 1 shows the overall structure of the image forming apparatus 1.

The image forming apparatus 1 is an electrophotographic color printer and combines images of four colors, namely, yellow (Y), magenta (M), cyan (C) and black (K) by a tandem method. The image forming apparatus 1 forms a toner image in accordance with image data read out by a scanner on a sheet (print medium) P with a developer composed of toner and magnetic carriers. As shown in FIG. 1, the image forming apparatus 1 comprises a printing section 2, a feeding section 15, a pair of timing rollers 19, a fixing device 20 and a printed-sheet tray 21.

The feeding section 15 feeds sheets P one by one. The feeding section 15 comprises a sheet tray 16 and a feed roller 17. On the sheet tray 16, a plurality of sheets P to be subjected to printing are stacked. The feed roller 17 picks up one sheet from the stack of sheets P on the sheet tray 16. The pair of timing rollers 19 feeds the sheet P in synchronized timing so that a toner image can be transferred onto the sheet P at the printing section 2.

The printing section 2 forms a toner image on the sheet P fed from the feeding section 15. The printing section 2 comprises image forming units 22 (22Y, 22M, 22C, 22K), optical scanning devices 6 (6Y, 6M, 6C, 6K), transfer devices 8 (8Y, 8M, 8C, 8K), an intermediate transfer belt 11, a driving roller 12, a driven roller 13, a secondary transfer roller 14 and a cleaning device 18. The image forming units 22 (22Y, 22M, 22C, 22K) each have a photosensitive drum 4 (4Y, 4M, 4C, 4K), a charger 5 (5Y, 5M, 5C, 5K), a developing device 7 (7Y, 7M, 7C, 7K), a cleaner 9 (9Y, 9M, 9C, 9K), an eraser 10 (10Y, 10M, 10C, 10K) and a DC source 30 (30Y, 30M, 30C, 30K).

The photosensitive drums 4 are cylindrical, and as shown in FIG. 1, each of the photosensitive drums 4 rotates clockwise. Accordingly, the peripheral surface (photoreceptor surface) of the photosensitive drum 4 travels in a specified direction in a position to face to a developing roller 72, which will be described later.

The chargers 5 charge the peripheral surfaces of the photosensitive drums 4. The optical scanning devices 6 are controlled by a control section (not shown) to scan the peripheral surfaces of the photosensitive drums 4 with beams BY, BM, BC and BK. Thereby, electrostatic latent images are formed on the peripheral surfaces of the photosensitive drums 4.

The developing devices 7 provide toner to the photosensitive drums 4. The DC sources 30 apply DC voltages to the developing devices 7, and toner moves from the developing devices 7 to the photosensitive drums 4. Thereby, the electrostatic latent images on the photosensitive drums 4 are developed into toner images. A detailed description of the developing devices 7 and the DC sources 30 will be given later.

The intermediate transfer belt 11 is stretched between the driving roller 12 and the driven roller 13 and receives the toner images transferred from the photosensitive drums 4. The transfer devices 8 are located in such positions to face to the inner surface of the intermediate transfer belt 11. First transfer voltages are applied to the transfer devices 8, and thereby, the toner images formed on the photosensitive drums 4 are transferred onto the intermediate transfer belt 11 and are combined into a composite color image (primary transfer). The cleaners 9 collect residual toner from the peripheral surfaces of the photosensitive drums 4 after the first transfer. The erasers 10 eliminate the charges from the peripheral surfaces of the photosensitive drums 4. The driving roller 12 is rotated by an intermediate transfer belt driving section (not shown) and drives the intermediate transfer belt 11 in a direction shown by arrow $\alpha$. Thereby, the intermediate transfer belt 11 carries the composite toner image to the secondary transfer roller 14.

The secondary transfer roller 14, which is cylindrical, is located in such a position to face to the intermediate transfer roller 11. A secondary transfer voltage is applied to the secondary transfer roller 14, and thereby, the composite toner image carried by the intermediate transfer belt 11 is transferred onto a sheet P passing through between the intermediate transfer belt 11 and the secondary transfer roller 14 (secondary transfer). Specifically, the driving roller 12 keeps the ground potential, and the intermediate transfer belt 11 keeps a positive potential close to the ground potential because the intermediate transfer belt 11 is in contact with the driving roller 12. Then, a positive voltage is applied to the secondary transfer roller 14 as the secondary transfer voltage such that the potential of the secondary transfer roller 14 becomes higher than the potentials of the driving roller 12 and the intermediate transfer belt 11. The toner image has a negative potential. Therefore, by the effect of an electric field generated between the driving roller 12 and the secondary transfer roller 14, the toner image is transferred from the intermediate transfer belt 11 to the sheet P.

After the secondary transfer of the toner image onto the sheet P, the cleaning device 18 eliminates toner from the intermediate transfer belt 11.

The sheet P with the toner image transferred thereon is fed to the fixing device 20. The fixing device 20 performs a heating treatment and a pressing treatment toward the sheet P, and thereby, the toner image is fixed on the sheet P. Thereafter, the sheet P is ejected onto the printed-sheet tray 21.

Structure of the Developing Devices

Figure 2:
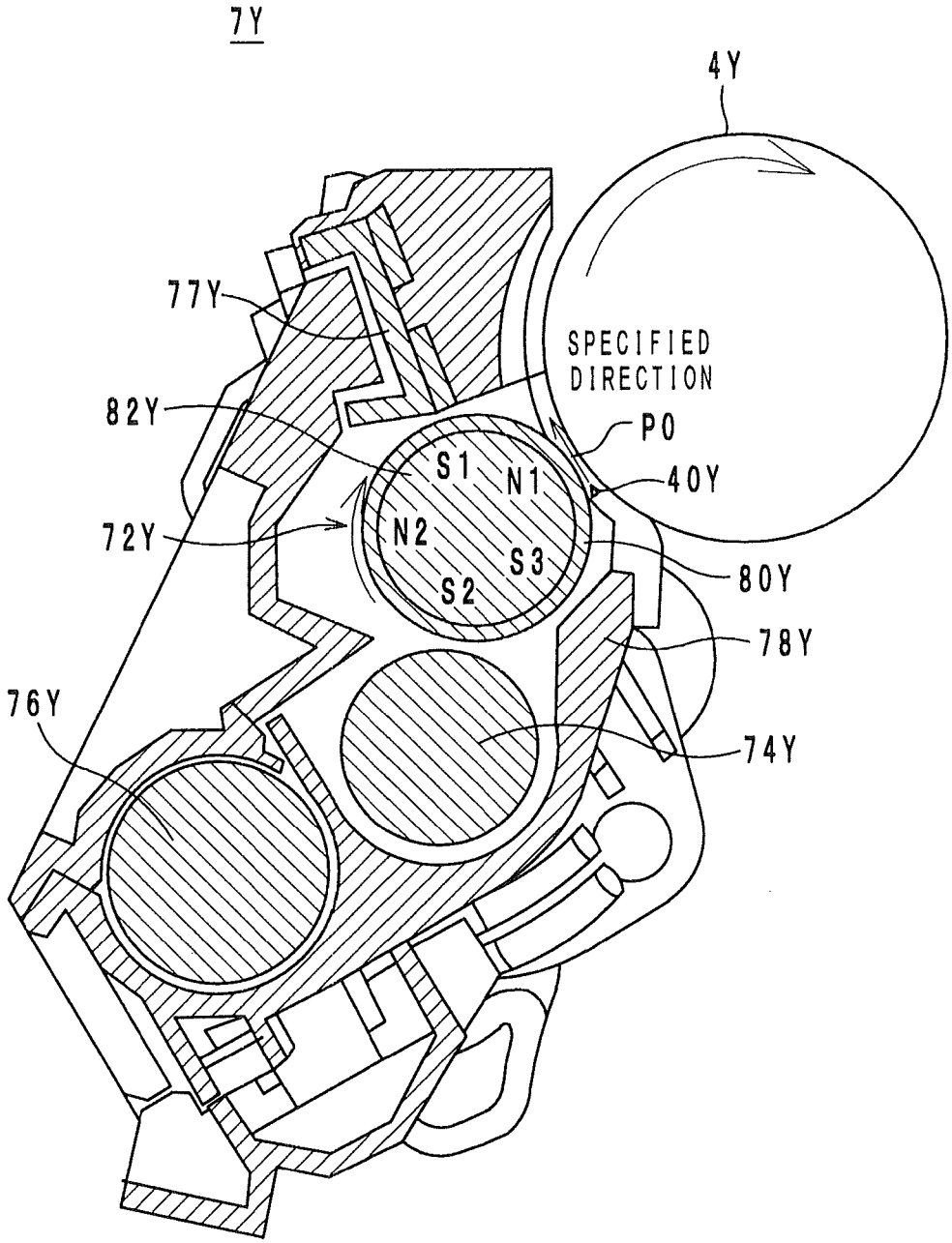
FIG. 2 is a sectional view of a developing device.

Next, the structure of the developing devices 7 (7Y, 7M, 7C, 7K) is described with reference to the drawings. FIG. 2 is a sectional view of the developing device 7Y. The developing devices 7Y, 7M, 7C and 7K are of the same structure, and in the following, the developing device 7Y is described as an example.

As shown in FIG. 2, the developing device 7Y comprises a developing roller 72Y, a supplying roller 74Y, a stirring roller 76Y, a blade 77Y and a container 78Y.

The container 78Y is the body of the developing device 7Y. In the container 78Y, toner is contained, and the developing roller 72Y, the supplying roller 74Y, the stirring roller 76Y and the blade 77Y are housed. The stirring roller 76Y stirs a developer contained in the container 78Y to charge the developer to a negative potential. The supplying roller 74Y supplies the developer to the developing roller 72Y. The developing roller 72Y provides toner to the peripheral surface of the photosensitive drum 4Y. The developing roller 72Y is composed of a sleeve 80Y and a magnet 82Y.

As shown in FIG. 2, the sleeve 80Y is a nonmagnetic metal cylinder and is located in such a position to face to the photosensitive drum 4Y. The sleeve 80Y rotates in the same direction as the photosensitive drum 4Y does, that is, the sleeve 80Y rotates clockwise. Thus, the photosensitive drum 4Y and the sleeve 80Y rotate to counter each other. The peripheral surface of the sleeve 80Y travels in the opposite direction to the peripheral surface of the photosensitive drum 4Y in the position to face to the photosensitive drum 4Y.

The magnet 82Y is located inside the sleeve 80Y and has magnetic poles N1, S1, N2, S2 and S3 to form magnetic fields. The magnet 82Y attracts the magnetic carriers of the developer onto its peripheral surface by the effect of the magnetic fields, and thereby, the developer is held on the peripheral surface of the sleeve 80Y. Specifically, in the magnet 82Y, the magnetic pole N1 is located to face to the photosensitive drum 4Y, and the magnetic poles N1, S1, N2, S2 and S3 are arranged counterclockwise in this order.

In the developing roller 72Y of this structure, the magnetic carriers are attracted by the magnetic pole S2 onto the peripheral surface of the sleeve 80Y. In this moment, toner stuck on the magnetic carriers is also attracted onto the peripheral surface of the sleeve 80Y. Thus, the developer is attracted onto the peripheral surface of the sleeve 80Y and is conveyed by rotation of the sleeve 80Y. In the meantime, the developer keeps attracted onto the peripheral surface of the sleeve 80Y by the effects of a magnetic field generated between the magnetic poles S2 and N2, a magnetic field generated between the magnetic poles N2 and S1 and a magnetic field generated between the magnetic poles S1 and N1. The blade 77Y is located upstream, with respect to the rotating direction of the sleeve 80Y, from the position where the photosensitive drum 4Y and the sleeve 80Y face to each other, and the blade 77Y is at a specified distance from the peripheral surface of the sleeve 80Y. Thereby, the developer held on the peripheral surface of the sleeve 80Y is regulated to a specified thickness while passing the space between the blade 77Y and the sleeve 80Y. Further, as will be described later, the toner of the developer moves from the peripheral surface of the sleeve 80Y to the peripheral surface of the photosensitive drum 4Y by the effect of an electric field generated between the photosensitive drum 4Y and the sleeve 80Y. Thereby, the electrostatic latent image on the photosensitive drum 4Y is developed into a toner image.

After the developer passes through between the photosensitive drum 4Y and the sleeve 80Y, the developer is conveyed further while being still held on the peripheral surface of the sleeve 80Y by the effect of the magnetic field between the magnetic poles N1 and S3. Thereafter, in the weak magnetic field between the magnetic poles S3 and S2, the developer comes off from the peripheral surface of the sleeve 80Y by the centrifugal force.

Now, the process of developing the electrostatic latent image on the photosensitive drum 4Y into a toner image is described in more detail. The DC source 30Y applies a DC voltage to the sleeve 80Y so that the electrostatic latent image can be developed with the toner of the developer held on the peripheral surface of the sleeve 80Y. More specifically, the charger 5Y charges the peripheral surface of the photosensitive drum 4Y to a potential of −650V. When the peripheral surface of the photosensitive drum 4Y is scanned with the beam BY, the exposed portion of the photosensitive drum 4Y becomes nearly equal to 0V. In the meantime, the DC source 30Y charges the peripheral surface of the sleeve 80Y to a potential of −500V. Thereby, between the exposed portion of the photosensitive drum 4Y and the peripheral surface of the sleeve 80Y, an electric field of which direction is from the exposed portion of the photosensitive drum 4Y to the peripheral surface of the sleeve 80Y is generated. Therefore, the toner, which is negatively charged, moves from the peripheral surface of the sleeve 80Y to the exposed portion of the photosensitive drum 4Y. On the other hand, between non-exposed portion of the photosensitive drum 4Y and the peripheral surface of the sleeve 80Y, an electric field of which direction is from the peripheral surface of the sleeve 80Y to the non-exposed portion of the photosensitive drum 4Y is generated. Therefore, the toner, which is negatively charged, does not move from the peripheral surface of the sleeve 80Y to the non-exposed portion of the photosensitive drum 4Y. In this way, a toner image in conformity with the electrostatic latent image is formed on the photosensitive drum 4Y.

Prevention of Density Unevenness

Figure 3:
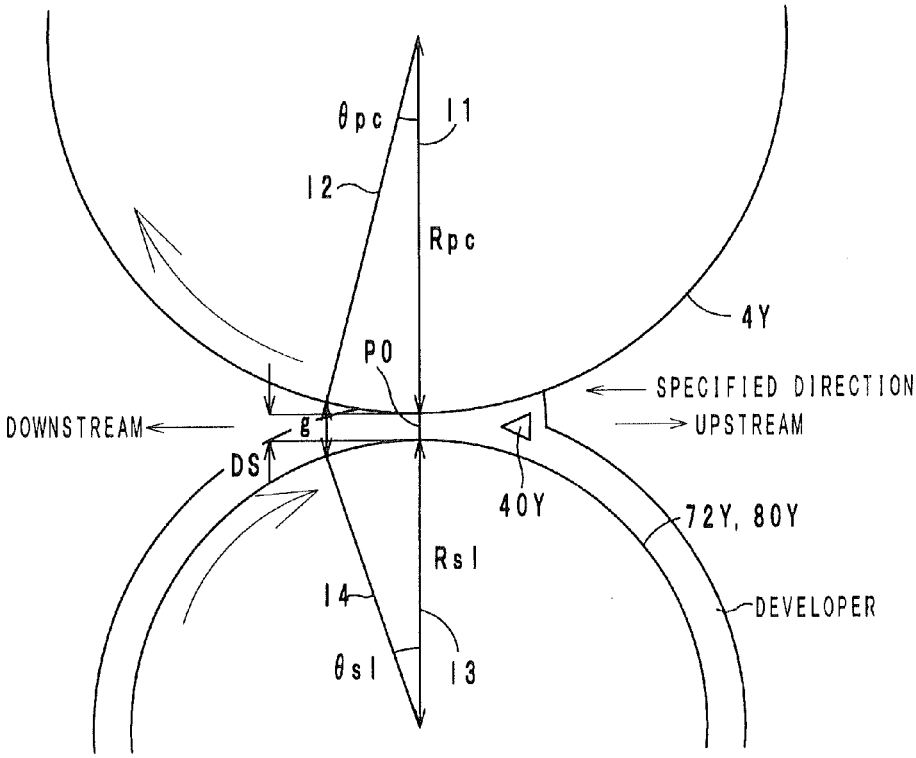
FIG. 3 is an enlarged view of a nip area between a developing roller and a photosensitive drum, and the vicinity thereof.

In order to prevent density unevenness from occurring on a toner image formed by the image forming apparatus 1 adopting the DC development method, the present inventors conceived of the idea of heightening a packing density. The packing density is hereinafter described with reference to FIG. 3. FIG. 3 is an enlarged view of a nip area between the developing roller 72Y and the photosensitive drum 4Y, and the vicinity thereof.

The packing density (PD) means the degree of packing of the developer in the space between the sleeve 80Y and the photosensitive drum 4Y. The packing density is calculated from the amount of developer adhering to a unit area of the peripheral surface of the sleeve 80Y (MA ($g/m^2$)), the density of the developer (ρ ($g/m^3$)) and the gap between the peripheral surface of the sleeve 80Y and the peripheral surface of the photosensitive drum 4Y in the packing density calculating position (g (m)), by use of the following expression (1).

$$PD=MA/\rho/g \quad (1)$$

The measurement of the value MA is performed, in a state where the photosensitive drum 4Y is not set, by averaging the weight of the developer adhering to the area subjected to the packing density calculation. More specifically, the sleeve 80Y is covered with a mask having an opening of 10 mm in a circumferential direction of the sleeve 80Y by 50 mm in a lengthwise direction of the sleeve 80Y. Then, the developer within the opening is sucked up, and the weight of the developer is measured. The value MA is calculated by dividing the weight of the developer by the area of the opening.

The value ρ is calculated by use of the following expression (2).

$$\rho=Tc\cdot\rho t+(1-Tc)\cdot\rho c \quad (2)$$

Tc: ratio by weight of toner to the developer

ρt: density of toner

ρc: density of carriers

The value g is calculated by use of the following expression (3).

$$g=DS+Rpc\cdot(1-\cos\theta pc)+Rsl\cdot(1-\cos\theta sl) \quad (3)$$

DS: distance between the peripheral surface of the sleeve 80Y and the peripheral surface of the photosensitive drum 4Y at the point where the peripheral surface of the sleeve 80Y and the peripheral surface of the photosensitive drum 4Y become closest to each other (the closest point P0)

Rpc: radius of the photosensitive drum 4Y

Figure 4:
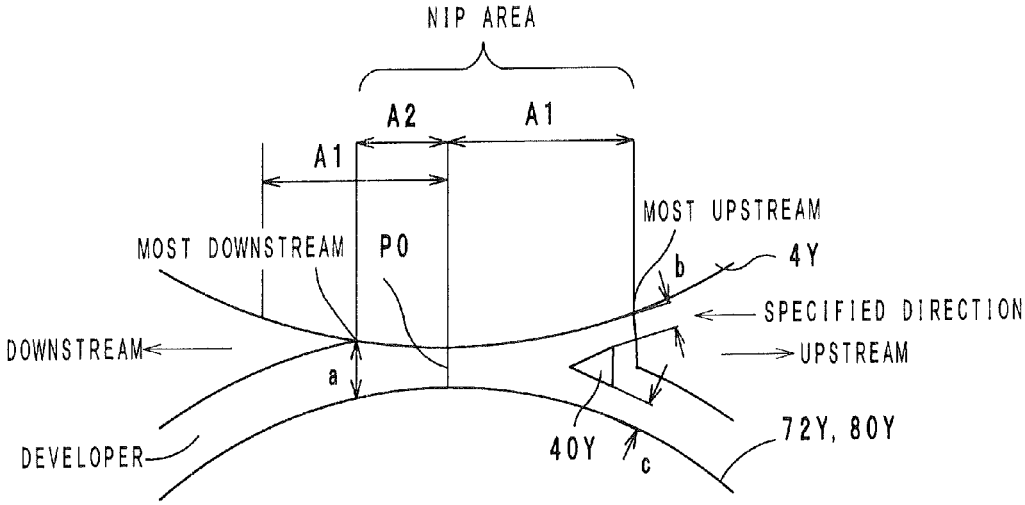
FIG. 4 is an enlarged view of the developing roller, the photosensitive drum and the control member.

Rsl: radius of the developing roller 72Y

θpc: angle of a line 11 extending from the center of the photosensitive drum 4Y to the closest point P0 to a line 12 extending from the center of the photosensitive drum 4Y to the packing density calculating position θsl: angle of a line 13 extending from the center of the developing roller 72Y to the closest point P0 to a line 14 extending from the center of the developing roller 72Y to the packing density calculating position The image forming apparatus 1 further comprises control members 40 (40Y, 40M, 40C, 40K) for heightening the packing density (see 40Y in FIGS. 2 and 3). As an example, the control member 40Y is hereinafter described. FIG. 4 is an enlarged view of the developing roller 72Y, the photosensitive drum 4Y and the control member 40Y.

As shown in FIG. 4, the control member 40Y faces to the peripheral surface of the photosensitive drum 4Y and is located upstream, with respect to the specified direction (the rotating direction of the photosensitive drum 4Y at the position to face to the sleeve 80Y), from the closest point P0 where the peripheral surface of the photosensitive drum 4Y and the peripheral surface of the sleeve 80Y become closest to each other. The cross section of the control member 40Y is a triangle that is thinning from the upstream side to the downstream side with respect to the specified direction. The control member 40Y is located upstream from the closest point P0 with respect to the specified direction and within a nip area wherein the developer held on the sleeve 81 is in contact with the peripheral surface of the photosensitive drum 4Y. In the following paragraphs, the terms "upstream" and "downstream" are used with respect to the specified direction, that is, with respect to the rotating direction of the photosensitive drum 4Y at the position to face to the sleeve 80Y, as long as no particular descriptions are given.

As shown in FIG. 4, the distance a between the peripheral surface of the photosensitive drum 4Y and the peripheral surface of the sleeve 80Y in the most downstream point of the nip area is larger than the distance c between the most upstream edge of the control member 40Y and the peripheral surface of the sleeve 80Y and is smaller than the sum of the distance c and the distance b between the upstream edge of the control member 40Y and the peripheral surface of the photosensitive drum 4Y.

Due to the existence of the control member 40Y, the packing density in the upstream portion of the nip area from the closest point P0 becomes higher. Now, the distance between the most upstream point of the nip area and the closest point P0 is defined as A1, and the distance between the most downstream point of the nip area and the closest point P0 is defined as A2.

Further, in the image forming apparatus 1 shown by FIG. 4, the average gap between the peripheral surface of the photosensitive drum 4Y and the control member 40Y or the peripheral surface of the sleeve 80Y in an area with a length of the distance A1 extending upstream from the closest point P0 is defined as B1. In the image forming apparatus 1 shown by FIG. 4, in the area with a length of the distance A1 extending upstream from the closest point P0, the peripheral surface of the photosensitive drum 4Y faces to the control member 40Y and the peripheral surface of the sleeve 80Y. Therefore, in order to calculate the value B1, within an area where the peripheral surface of the photosensitive drum 4Y faces to the control member 40Y, the gap between the peripheral surface of the photosensitive drum 4Y and the control member 40Y is measured, and within an area where the peripheral surface of the photosensitive drum 4Y faces to the peripheral surface of the sleeve 80Y, the gap between the peripheral surface of the photosensitive drum 4Y and the peripheral surface of the sleeve 80Y is measured. Also, the average gap between the peripheral surface of the photosensitive drum 4Y and the peripheral surface of the sleeve 80Y in an area with a length of the distance A1 extending downstream from the closest point P0 is defined as B2.

In the image forming apparatus 1, due to the existence of the control member 40Y, the value B1 is smaller than the value B2. That is, in the image forming apparatus 1 comprising the control member 40Y, the space for the developer between the photosensitive drum 4Y and the sleeve 80Y in the upstream portion of the nip area from the closest point P0 is smaller than the space for the developer in the corresponding portion of an image forming apparatus not comprising the control member 40Y. Accordingly, in the image forming apparatus 1, the degree of packing of developer, that is, the packing density in the upstream portion of the nip area from the closest point P0 is higher than that in the corresponding portion of an image forming apparatus not comprising the control member 40Y. Consequently, in the image forming apparatus 1, a larger amount of toner contributes to development, and even if the gap between the peripheral surface of the photosensitive drum 4Y and the peripheral surface of the sleeve 80Y fluctuates due to non-uniform rotations of the photosensitive drum 4Y and the sleeve 80Y, density unevenness can be prevented from occurring on a toner image formed by the image forming apparatus 1.

As shown in FIG. 4, in the image forming apparatus 1, further, the distance c is smaller than the distance a. Therefore, part of the developer flowing to the closest point P0 with the rotation of the sleeve 80Y cannot pass through the space between the control member 40Y and the sleeve 80Y, and flows into the space between the control member 40Y and the photosensitive drum 4Y. Thereby, in the image forming apparatus 1, the upstream portion of the nip area from the closest point P0 extends longer than that in an image forming apparatus not comprising the control member 40Y. Consequently, in the image forming apparatus 1, a larger amount of toner contributes to development than in an image forming apparatus not comprising the control member 40Y, and density unevenness can be prevented from occurring on a toner image formed by the image forming apparatus 1.

In the image forming apparatus 1, further, stripe noise can be suppressed. When the packing density in an image forming apparatus is high, generally, it is likely that carriers come into contact with a toner image, thereby causing stripe noise in the trailing edge of the toner image.

In the image forming apparatus 1, however, the packing density in the downstream portion of the nip area from the closest point P0 is lower than that in the upstream portion of the nip area from the closest point P0. That is, in the image forming apparatus 1, the packing density in the upstream portion of the nip area from the closest point P0 is heightened, while the packing density in the downstream portion of the nip area from the closest point P0 is not heightened. Therefore, in the image forming apparatus 1, the carriers are prevented from coming into contact with the trailing edge of the toner image, whereby stripe noise is suppressed.

In the image forming apparatus 1, in order to suppress stripe noise, it is preferred that the direction in which the magnetic pole N1 has the maximum magnetic flux density is set down. More specifically, it is preferred that the direction in which the magnetic pole N1 has the maximum magnetic flux density is inclined upstream from the line connecting the peripheral surface of the photosensitive drum 4Y and the peripheral surface of the sleeve 80Y at the closest point P0. Thereby, the packing density in the downstream portion of the nip area from the closest point P0 is lowered. Consequently, in the image forming apparatus 1, the carriers are prevented from coming into contact with the trailing edge of the toner image, whereby stripe noise is surely suppressed.

Experimental Results

The inventors of the present invention conducted the following experiment so as to prove that the image forming apparatus 1 can suppress density unevenness and stripe noise on toner images. More specifically, three image forming apparatuses wherein the difference between the values B1 and B2 is 0 μm, −56 μm and −84 μm, respectively, were produced as a first, a second and a third sample. The first sample is a comparative example, and the second sample and the third sample are examples of the image forming apparatus 1 according to the first embodiment. Then, toner images formed by the first sample, the second sample and the third sample were examined about density unevenness and stripe noise.

In the first sample, the second sample and the third sample, the direction in which the magetic pole N1 has the maximum magnetic flux density was set down such that the angle of the direction to the line connecting the peripheral surface of the photosensitive drum 4Y and the peripheral surface of the sleeve 80Y at the closest point P0 would be −10 degrees, 0 degrees and 10 degrees, respectively. Thereby, in the first sample, the second sample and the third sample, the difference ΔMA between the density of developer MA supported by the sleeve 80Y in the upstream portion of the nip area from the closest point P0 and the density of developer MA supported by the sleeve 80Y in the downstream portion of the nip area from the closest point P0 was −20 g/m$^2$, 10 g/m$^2$ and 20 g/m$^2$, respectively. The positive value as the angle indicates that the direction in which the magnetic pole N1 has the maximum magnetic flux density is inclined to the upstream side with respect to the specified direction, and the negative value as the angle indicates that the direction in which the magnetic pole N1 has the maximum magnetic flux density is inclined to the downstream side with respect to the specified direction. The packing density at the closest point P0 was set to $0.25\times10^6$ g/m$^3$ and $0.30\times10^6$ g/m$^3$. The conditions of the control member 40 are shown in Table 1. In Table 1, the "length" means the dimension of the control member 40 in the specified direction, and the "thickness" means the dimension of the control member 40 in the direction orthogonal to the specified direction.

TABLE 1

| | A1 (mm) | Thickness (mm) | Length (mm) |
|---|---|---|---|
| First Sample | 3 | — | — |
| Second Sample | 5 | 0.2 | 1.5 |
| Third Sample | 5 | 0.3 | 1.5 |

Table 2 shows the experimental results when the packing density was $0.25\times10^6$ g/m$^3$, and Table 3 shows the experimental results when the packing density was $0.30\times10^6$ g/m$^3$. Table 4 shows the meanings of the grades shown in Table 2 and Table 3.

TABLE 2

| ΔMA (g/m$^2$) | First Sample | Second Sample | Third Sample |
|---|---|---|---|
| 20 | C | A | A |
| 0 | C | A | A |
| −20 | D | B | B |

TABLE 3

| ΔMA (g/m$^2$) | First Sample | Second Sample | Third Sample |
|---|---|---|---|
| 20 | C | A | A |
| 0 | D | B | A |
| −20 | D | B | B |

TABLE 4

| ΔMA (g/m$^2$) | Density Unevenness | Stripe Noise |
|---|---|---|
| A | OK | OK |
| B | OK | NG |
| C | NG | OK |
| D | NG | NG |

As is apparent from Tables 2, 3 and 4, in the second sample and the third sample, density unevenness on toner images was suppressed, while in the first sample, density unevenness occurred on toner images. Thus, it is apparent from the experimental results that by causing the value B1 to become smaller than the value B2, density unevenness on toner images can be suppressed.

Also, as is apparent from Tables 2, 3 and 4, in the second sample and in the third sample, when the difference in the density of developer ΔMA was 0 g/m$^2$ and when the difference in the density of developer ΔMA was 20 g/m$^2$, stripe noise on toner images was suppressed. On the other hand, in the second sample and in the third sample, when the difference in the density of developer ΔMA was −20 g/m$^2$, stripe noise occurred on toner images. Thus, it is apparent from the experimental results, by arranging the magnetic pole N1 so as to have the maximum magnetic density in a direction inclining to the upstream side from the line connecting the peripheral surface of the photosensitive drum 4Y and the peripheral surface of the sleeve 80Y at the closest point P0, stripe noise on toner images can be suppressed.

Modifications

Some modifications of the control member 40 are hereinafter described with reference to the drawings. FIGS. 5*a* to 5*d* show modified control members 40*a*Y to 40*d*Y.

Figure 5A:
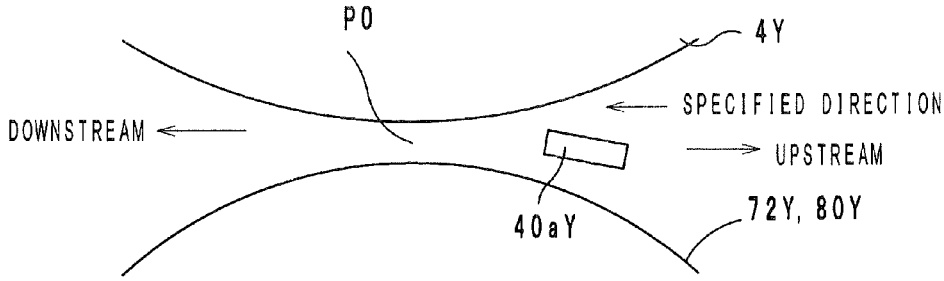
FIGS. 5*a* to 5*d* are enlarged views of the developing roller, the photosensitive drum and modifications of the control member.
Figure 5B:
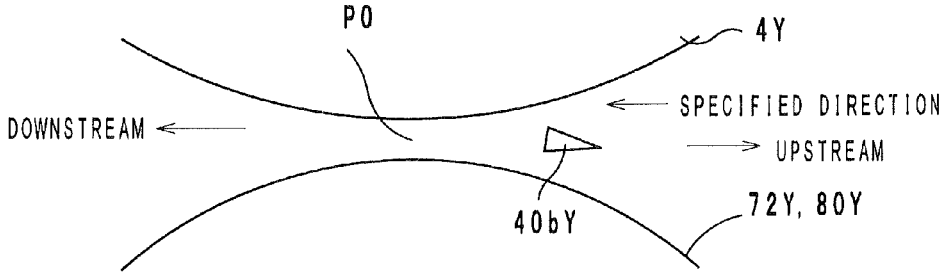
Figure 5C:
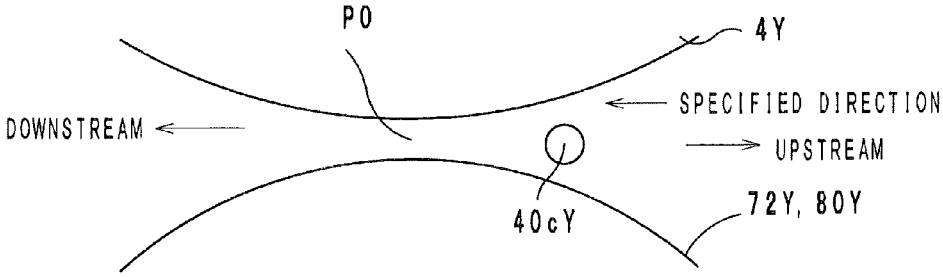
Figure 5D:
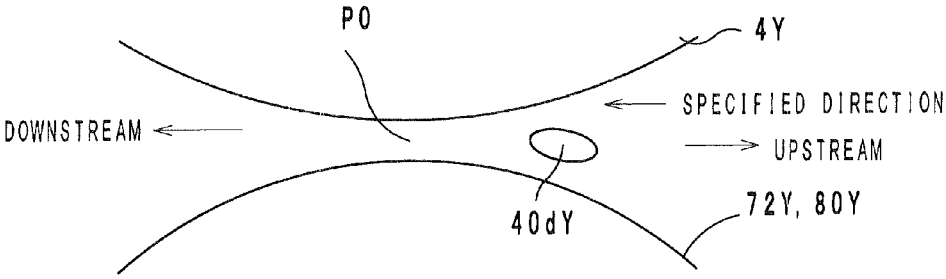

According to a first modification, as shown by FIG. 5*a*, the control member 40*a*Y may have a rectangular cross section. According to a second modification, as shown by FIG. 5*b*, the control member 40*b*Y may have a triangular cross section that becomes thicker from the upstream side to the downstream side with respect to the specified direction. According to a third modification, as shown by FIG. 5*c*, the control member 40*c*Y may have a circular cross section. According to a fourth embodiment, as shown by FIG. 5*d*, the control section 40*d*Y may have an oval cross section.

Second Embodiment

Figure 6:
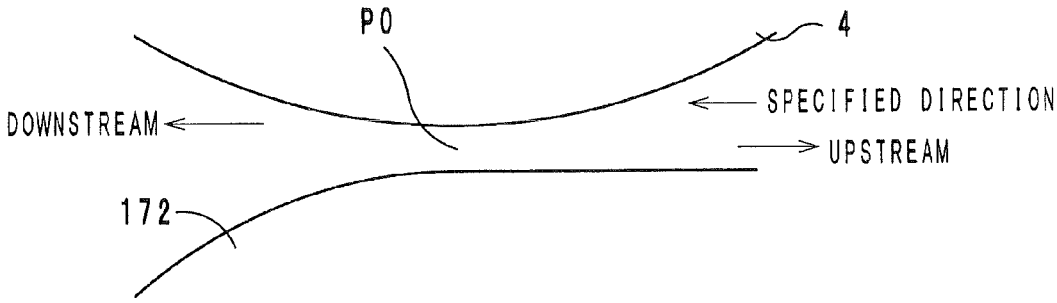
FIG. 6 is an enlarged view of a photosensitive drum and a developing belt in an image forming apparatus according to a second embodiment.

Next, an image forming apparatus 1 according to a second embodiment is described with reference to the drawings. FIG. 6 is an enlarged view of a photosensitive drum 4 and a developing belt 172 in the image forming apparatus 1 according to the second embodiment.

In the image forming apparatus 1 according to the second embodiment, developing belts 172 are used in place of the developing rollers 72. In the image forming apparatus 1 according to the second embodiment, the gap between the peripheral surface of the photosensitive drum 4 and the peripheral surface of the developing belt 172 in each of the image forming units 22 can be set arbitrarily. In the second embodiment, as shown by FIG. 6, the gap between the peripheral surface of the photosensitive drum 4 and the peripheral surface of the developing belt 172 in the upstream portion from the closest point P0 is set smaller than that in the downstream portion from the closest point P0. Accordingly, the packing density in the upstream portion of the nip area from the closest point P0 is higher than that in the downstream portion of the nip area from the closest point P0. Consequently, density unevenness on toner images can be suppressed.

In the image forming apparatus 1 according to the second embodiment, the control members 40 are unnecessary. In each of the image forming units 22, the member that faces to the photosensitive drum 4 in the nip area is only the developing belt 172.

Third Embodiment

Figure 7:
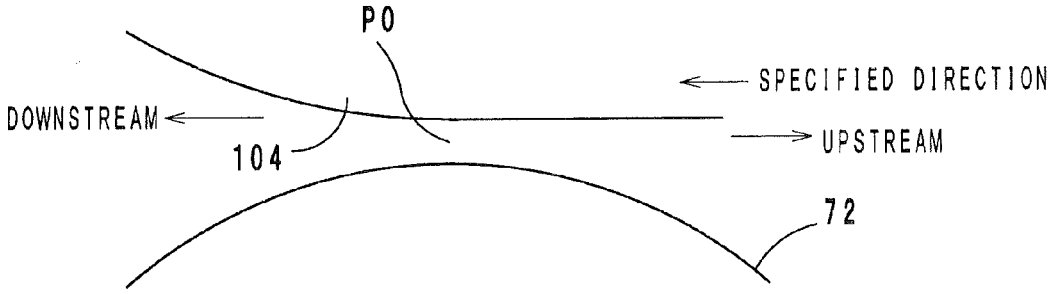
FIG. 7 is an enlarged view of a photosensitive belt and a developing roller in an image forming apparatus according to a third embodiment.

Next, an image forming apparatus according to a third embodiment is described with reference to the drawings. FIG. 7 is an enlarged view of a photosensitive belt 104 and a developing roller 72 in the image forming apparatus 1 according to the third embodiment.

In the image forming apparatus 1 according to the third embodiment, photosensitive belts 104 are used in place of the photosensitive drums 4. In the image forming apparatus 1 according to the third embodiment, the gap between the peripheral surface of the photosensitive belt 104 and the peripheral surface of the developing roller 72 in each of the image forming units 22 can be set arbitrarily. In the third embodiment, as shown by FIG. 7, the gap between the peripheral surface of the photosensitive belt 104 and the peripheral surface of the developing roller 72 in the upstream portion from the closest point P0 is set smaller than that in the downstream portion from the closest point P0. Accordingly, the packing density in the upstream portion of the nip area from the closest point P0 is higher than that in the downstream portion of the nip area from the closest point P0. Consequently, density unevenness on toner images can be suppressed.

In the image forming apparatus 1 according to the third embodiment, the control members 40 are unnecessary. In each of the image forming units 22, the member that faces to the photosensitive belt 104 in the nip area is only the developing roller 72.

Fourth Embodiment

Figure 8:
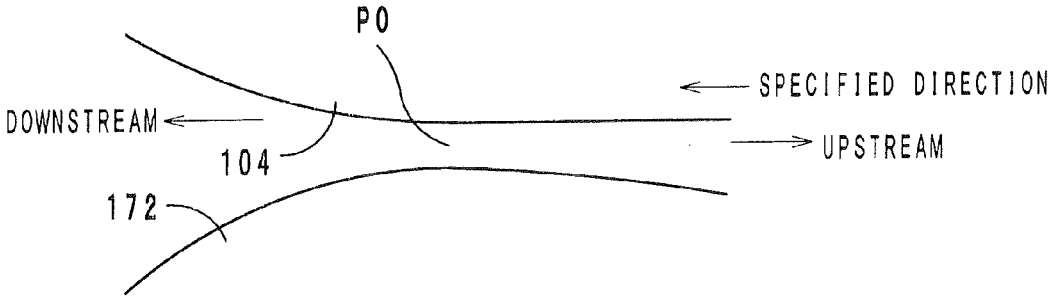
FIG. 8 is an enlarged view of a photosensitive belt and a developing belt in an image forming apparatus according to a fourth embodiment.

Next, an image forming apparatus according to a fourth embodiment is described with reference to the drawings. FIG. 8 is an enlarged view of a photosensitive belt 104 and a developing belt 172 in the image forming apparatus 1 according to the fourth embodiment.

In the image forming apparatus 1 according to the fourth embodiment, photosensitive belts 104 are used in place of the photosensitive drums 4, and developing belts 172 are used in place of the developing rollers 72. In the image forming apparatus 1 according to the fourth embodiment, the gap between the peripheral surface of the photosensitive belt 104 and the peripheral surface of the developing belt 172 in each of the image forming units 22 can be set arbitrarily. In the fourth embodiment, as shown by FIG. 8, the gap between the peripheral surface of the photosensitive belt 104 and the peripheral surface of the developing belt 172 in the upstream portion from the closest point P0 is set smaller than that in the downstream portion from the closest point P0. Accordingly, the packing density in the upstream portion of the nip area from the closest point P0 is higher than that in the downstream portion of the nip area from the closest point P0. Consequently, density unevenness on toner images can be suppressed.

In the image forming apparatus 1 according to the fourth embodiment, the control members 40 are unnecessary. In each of the image forming units 22, the member that faces to the photosensitive belt 104 in the nip area is only the developing belt 172.

Other Embodiments

In the image forming apparatuses 1 according to the first to the fourth embodiments described above, the distance A1 between the most upstream point of the nip area and the closest point P0 is longer than the distance A2 between the most downstream point of the nip area and the closest point P0. However, the distance A1 may be shorter than the distance A2.

When the distance A1 is shorter than the distance A2, it is necessary that an average gap C1 between the peripheral surface of the photosensitive drum 4Y and the peripheral surface of the control member 40Y or the sleeve 80Y in an area with a length of the distance A2 extending upstream from the closest point P0 is smaller than an average gap C2 between the peripheral surface of the photosensitive drum 4Y and the peripheral surface of the sleeve 80Y in an area with a length of the distance A2 extending downstream from the closest point P0. With this arrangement, density unevenness on toner images can be suppressed.

Although the present invention has been described in connection with the preferred embodiments above, it is to be noted that various changes and modifications are possible to those who are skilled in the art. Such changes and modifications are to be understood as being within the scope of the invention.

What is claimed is:

1. An image forming apparatus for forming a toner image on a print medium with a developer composed of toner and carriers, said image forming apparatus comprising:

an image support member having a first peripheral surface for supporting an electrostatic latent image thereon, the first peripheral surface traveling in a specified direction;

a developing device comprising a developer support member having a second peripheral surface for supporting the developer thereon, the second peripheral surface traveling in a direction opposite to the first peripheral surface at a point where the second peripheral surface faces to the first peripheral surface, the developing device attracting the carriers of the developer by an effect of a magnetic field so as to hold the developer on the second peripheral surface; and a voltage applying device for applying a DC voltage to the second peripheral surface such that the electrostatic latent image supported on the first peripheral surface is developed with the developer supported on the second peripheral surface;

wherein between the first peripheral surface and the second peripheral surface, an area in which the developer is in contact with the first peripheral surface is defined as a nip area, a distance between a most upstream point, with respect to the specified direction, of the nip area and a closest point at which the first peripheral surface and the second peripheral surface are the closest to each other is defined as a first distance, and a distance between a most downstream point, with respect to the specified direction, of the nip area and the closest point is defined as a second distance;

wherein when the first distance is longer than the second distance, an average gap between the first peripheral surface and a member that faces the first peripheral surface in an area with a length of the first distance extending upstream from the closest point with respect to the specified direction is smaller than an average gap between the first peripheral surface and a member that faces the first peripheral surface in an area with a length of the first distance extending downstream from the closest point with respect to the specified direction;

wherein when the first distance is equal to or shorter than the second distance, an average gap between the first peripheral surface and a member that faces the first peripheral surface in an area with a length of the second distance extending upstream from the closest point with respect to the specified direction is smaller than an average gap between the first peripheral surface and a member that faces the first peripheral surface in an area with a length of the second distance extending downstream from the closest point with respect to the specified direction; and wherein the member that faces the first peripheral surface upstream from the closest point with respect to the specified direction is located so that a degree of packing of developer in the nip area extending from the closest point with respect to the specified direction is higher than in the nip area extending downstream from the closest point with respect to the specified direction.

2. An image forming apparatus according to claim 1, further comprising a control member located upstream from the closest point with respect to the specified direction, wherein the member that faces the first peripheral surface is the control member or the second peripheral surface.

3. An image forming apparatus according to claim 2, wherein a gap between the first peripheral surface and the second peripheral surface at the most downstream point of the nip area is greater than a gap between the second peripheral surface and the control member and is smaller than a sum of the gap between the first peripheral surface and the control member and a gap between the second peripheral surface and the control member.

4. An image forming apparatus according to claim 1, wherein the member that faces the first peripheral surface is only the second peripheral surface.

5. An image forming apparatus according to claim 1, wherein a magnetic pole that faces the first peripheral surface and that serves to generate the magnetic field has a maximum magnetic flux density in a direction inclining upstream with respect to the specified direction from a line connecting the first peripheral surface and the second peripheral surface at the closest point.

* * * * *